US005950578A

United States Patent [19]

Hirano et al.

[11] Patent Number: 5,950,578

[45] Date of Patent: Sep. 14, 1999

[54] AIR-COOLED ENGINE

[75] Inventors: Tomohiro Hirano; Shinji Katayama; Takao Nishida, all of Wako, Japan

[73] Assignee: Honda Giken Kogyo Kabushiki Kaisha, Tokyo, Japan

[21] Appl. No.: 08/947,161

[22] Filed: Oct. 8, 1997

[30] Foreign Application Priority Data

Oct. 9, 1996 [JP] Japan ..... 8-268468

[51] Int. Cl.[6] ..... F01P 7/04

[52] U.S. Cl. ..... 123/41.65; 123/41.7

[58] Field of Search ..... 123/41.65, 41.67, 123/41.69, 41.7

[56] References Cited

U.S. PATENT DOCUMENTS 4,590,890 5/1986 Tamba et al. ..... 123/41.7

FOREIGN PATENT DOCUMENTS 2574853 6/1986 France ..... 123/41.65

57-30407 7/1982 Japan .

*Primary Examiner*—Noah P. Kamen

*Attorney, Agent, or Firm*—Armstrong, Westman, Hattori, McLeland and Naughton

[57] ABSTRACT

An air-cooled engine includes a cooling fan mounted at one end of a crankshaft supported in a crankcase, and a shroud for guiding cooling air flow produced by the cooling fan encloses an outer periphery of a cylinder block. The engine further includes an auxiliary cooling fan mounted at the other end of the crankshaft, together with an auxiliary shroud for guiding cooling air flow produced by the auxiliary cooling fan to an outer periphery of the crankcase, so that the absorption of heat from the cylinder block by the crankcase can be effectively increased. Thus, it is possible to enhance the effect of cooling of an air-cooled engine without increasing the size of the cooling fan and the shroud thereof.

6 Claims, 4 Drawing Sheets

AIR-COOLED ENGINE

BACKGROUND OF THE INVENTION

1. Field of the Invention

The present invention relates to an air-cooled engine and, particularly, to an improvement in an air-cooled engine including a cooling fan mounted at one end of a crankshaft supported in a crankcase, and a shroud for guiding a flow of cooling air produced by the cooling fan to an outer periphery of a cylinder block.

2. Description of the Related Art

Air-cooled engines are already known, for example, as disclosed in Japanese Utility Model Publication No. 57-30407.

In the known air-cooled engine, if a high cooling effect is desired, it is a common practice to increase the diameter of the cooling fan mounted at one end of the crankshaft and to enlarge the cooling air flow passage to provide an increase in amount of cooling air. The use of such a practice is accompanied by increases in size and weight of the engine.

SUMMARY OF THE INVENTION

Accordingly, it is an object of the present invention to provide an air-cooled engine of the above-described type, wherein the cooling effect for the engine can be enhanced, while minimizing the required increases in size and weight of the engine.

To achieve the above object, according to a first aspect and feature of the present invention, there is provided an air-cooled engine comprising a cooling fan mounted at one end of a crankshaft supported in a crankcase, and shroud for guiding the flow of cooling air produced by the cooling fan to an outer periphery of a cylinder block. The engine farther includes an auxiliary cooling fan mounted at the other end of the crank shaft, and an auxiliary shroud for guiding cooling air produced by the auxiliary cooling fan to an outer periphery of the crankcase.

By practice of the present invention, the absorption of heat from the cylinder block by the crankcase can be effectively performed by cooling the crankcase by the cooling air produced by the auxiliary cooling fan. Also, the effect of cooling the entire engine, including the cylinder block, can be enhanced without increasing the amount of the cooling air flowing to the cylinder block, i.e., without increasing the diameter of the cooling fan and the size of the shroud. Therefore, the increases in size and weight of the engine can be avoided.

According to a second aspect and feature of the present invention, in addition to the first feature, an oil reservoir chamber is defined in the crankcase adjacent the auxiliary cooling fan.

As a result of the present invention, when the crankcase is cooled by the auxiliary cooling fan, the lubricating oil in the oil reservoir chamber can be cooled satisfactorily. Hence, the lubrication and cooling of the inside of the engine by the lubricating oil can be effectively performed.

Further, according to a third aspect and feature of the present invention, in addition to the first or second feature, the auxiliary shroud is also formed to guide a portion of cooling air produced by the auxiliary cooling fan to an outer periphery of a fuel tank disposed on one side of the crankcase.

As a result of such third feature of the present invention, a portion of the cooling air produced by the auxiliary cooling fan can be conducted to the region around the fuel tank whereby the fuel in the fuel tank can also be cooled utilizing the auxiliary cooling fan.

The above and other objects, features and advantages of the invention will become apparent from the following description of the preferred embodiments taken in conjunction with the accompanying drawings.

DETAILED DESCRIPTION OF THE PREFERRED EMBODIMENTS

The present invention will now be described by way of an embodiment with reference to the accompanying drawings.

Figure 1:
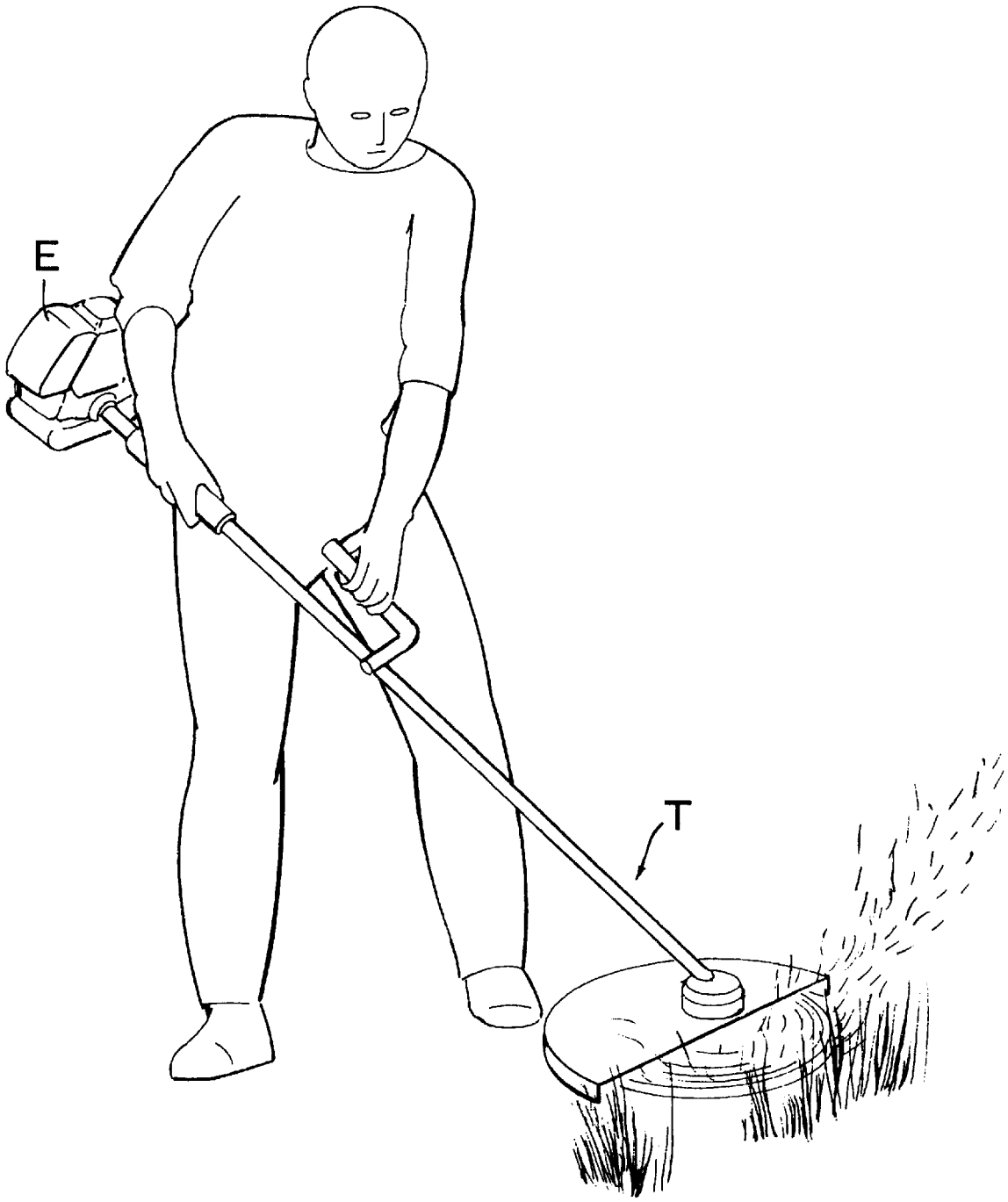
FIG. 1 is a perspective view illustrating one example of use of a hand-held type air-cooled engine according to the present invention.

Referring first to FIG. 1, a hand-held-type air-cooled engine E is mounted as a power source for a power trimmer T, for example, at a driving portion of the power trimmer T. The power trimmer T is used with a cutter which can be turned in various directions depending upon the working state of the power trimmer T. Consequently, the operational attitude of the engine E is, in many instances, inclined or turned upside down, and not regular.

Referring to FIGS. 1 to 4, a carburetor 2 and an exhaust muffler 3 are mounted on an engine body 1 of the air-cooled engine E at front and rear portions thereof. An air cleaner 4 is mounted at an inlet of an intake passage in the carburetor 2. A fuel tank 5 is mounted to a lower surface of the engine body 1. The carburetor 2 includes a diaphragm pump for pumping fuel from the fuel tank 5 by utilizing a pulsing of pressure within a crank chamber in the engine E and circulating an extra amount of fuel to the tank 5, so that the fuel can be supplied to an intake port in the engine E in any attitude of the engine E.

The engine body 1 is comprised of a head-integral type cylinder block 6, and a crankcase 7 bonded to a lower end face of the cylinder block 6. The cylinder block 6 includes a single cylinder 9 with a piston 8 accommodated therein, at a center portion thereof, and has a large number of cooling fins 10 provided on an outer periphery thereof.

The crankcase 7 is comprised of a pair of upper and lower case portions 7*a* and 7*b* coupled to each other by a bolt. A crankshaft 12 is connected to the piston 8 through a connecting rod 11 and supported between both of the case portions 7*a* and 7*b*.

Figure 2:
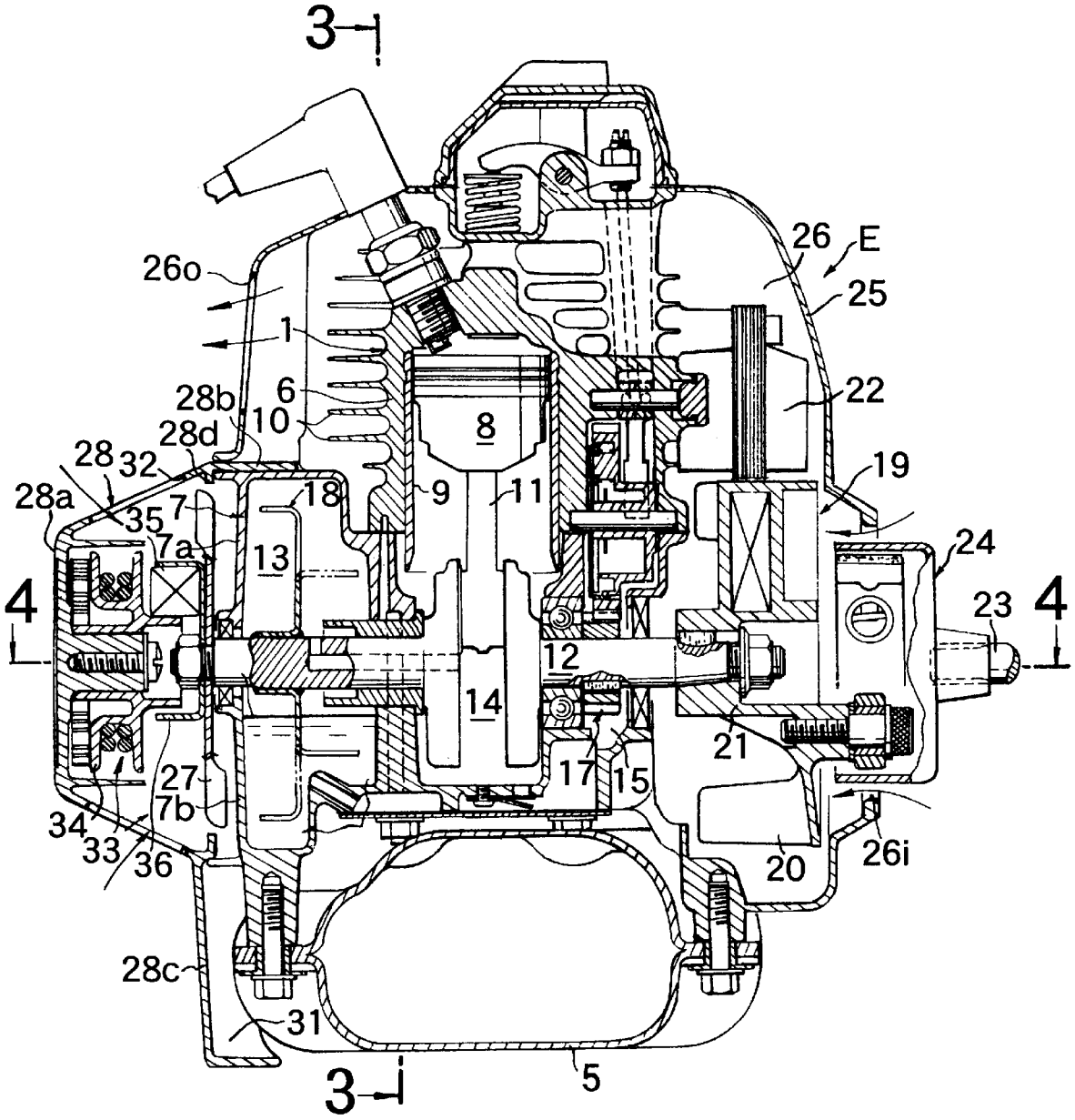
FIG. 2 is a vertical sectional front view of the engine.
Figure 3:
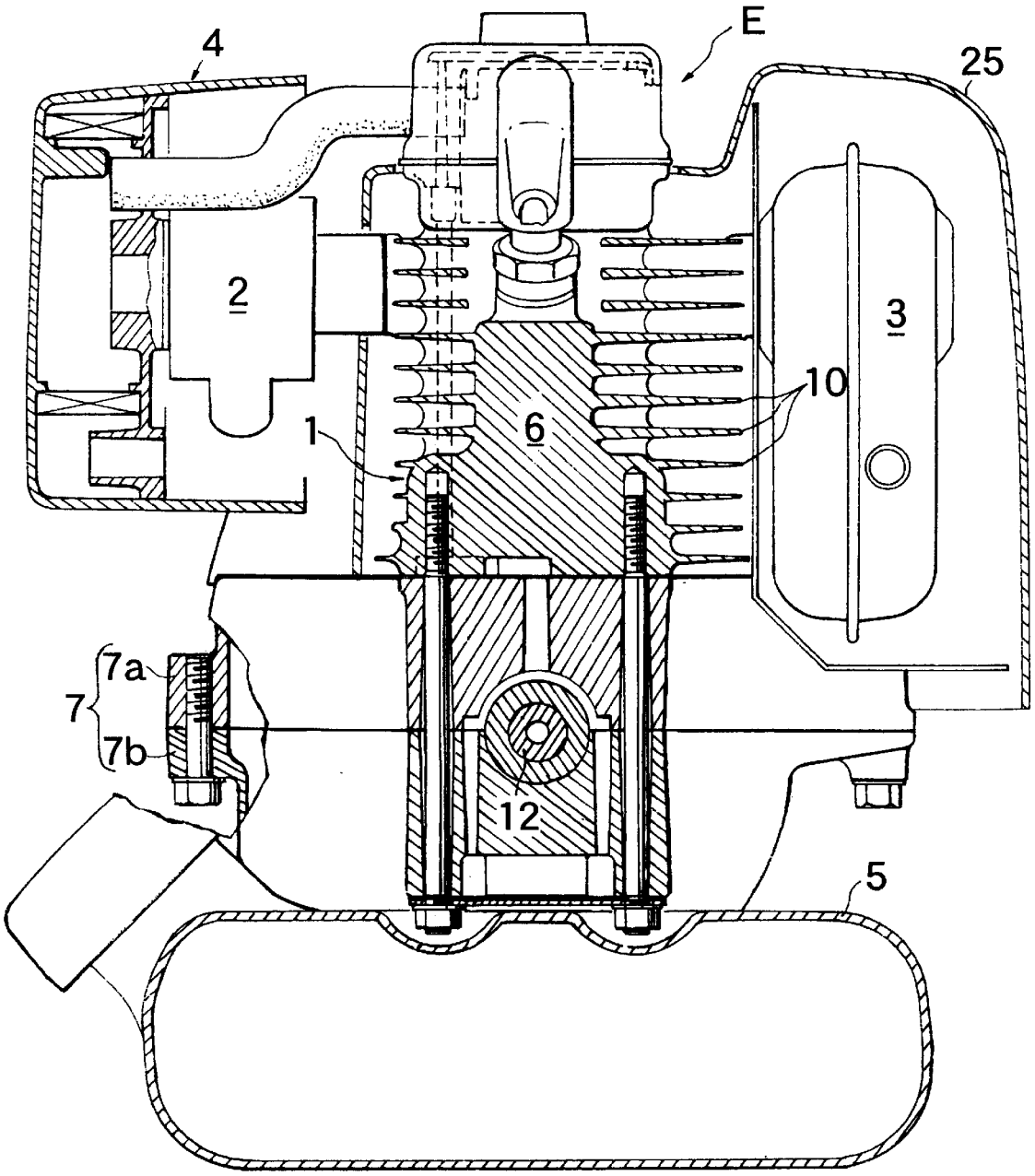
FIG. 3 is a sectional view taken along a line 3—3 in FIG. 2.
Figure 4:
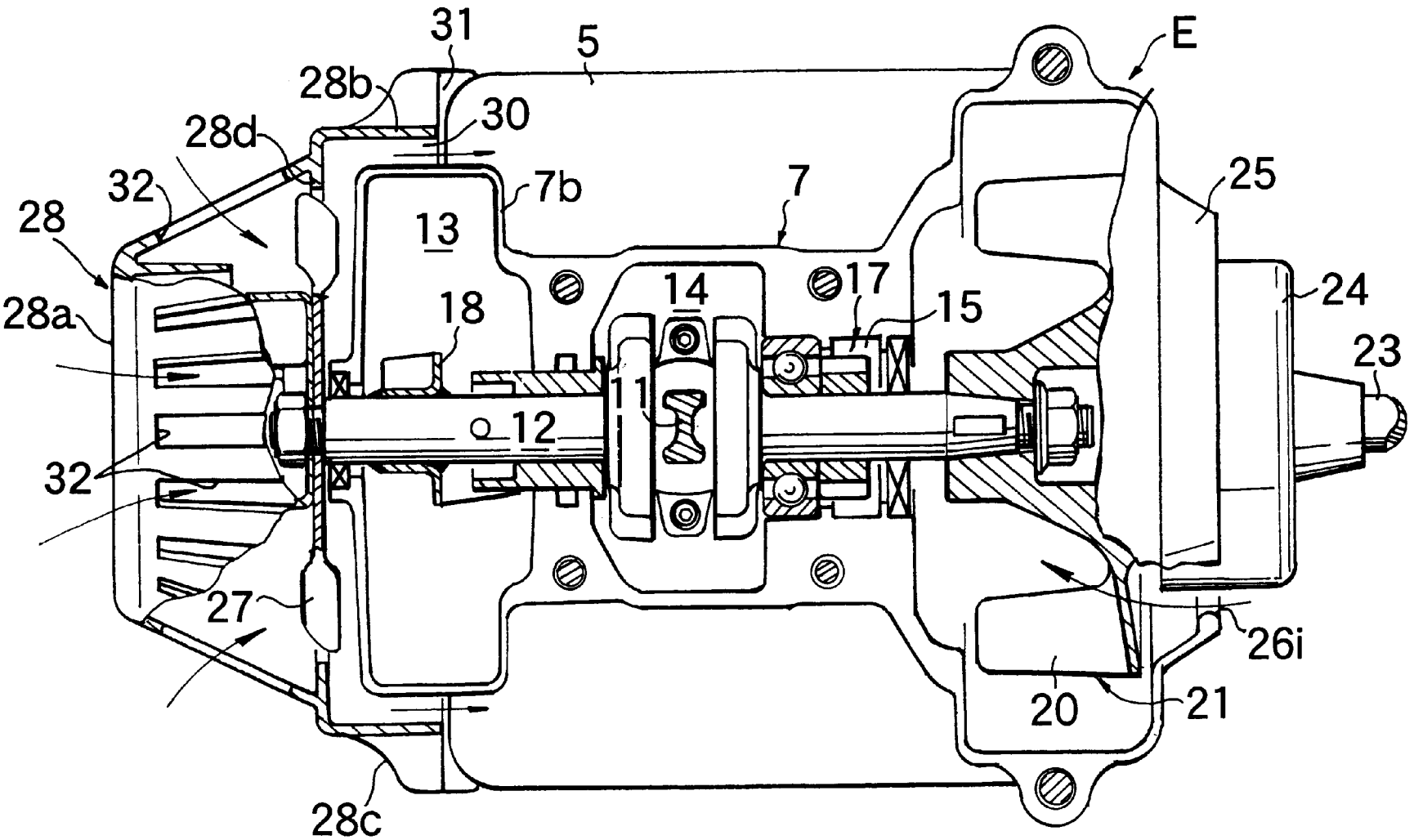
FIG. 4 is a sectional view taken along a line 4—4 in FIG. 2.

The inside of the crankcase 7 is divided into three chambers: a left oil reservoir chamber 13, a central crank chamber 14 and a right valve operating chamber 15 as shown in FIG. 2. A crank portion of the crankshaft 12 is disposed in the crank chamber 14, and a valve operating mechanism 17 for driving intake and exhaust valves located in a cylinder head is mounted in the valve operating chamber 15. A defined amount of lubricating oil O is stored in the oil reservoir chamber 13, and an oil slinger 18 for agitating the lubricating oil O to produce an oil mist is secured to the crankshaft 12. The oil mist produced in the oil reservoir chamber 13 is supplied to movable portions of the engine within the crank chamber 14 and the valve operating chamber 15 and is circulated to the oil reservoir chamber 13 after lubrication of the movable portions.

A rotor 21 of a flywheel magneto 19 and provided with a cooling fan 20, termed "the first fan" herein, is secured to an outer end of the crankshaft 12 adjacent the valve operating chamber 15, and an ignition coil 22 cooperating with the rotor 21 is secured to the cylinder block 6. A centrifugal clutch 24 is interposed between the rotor 21 and a working machine-driving shaft 23.

A shroud 25, designated "the first shroud", is mounted to enclose the rotor 21 and the cylinder block 6, thereby defining a cooling-air passage 26 extending from around the rotor 21 via one side of the cylinder block 6 (on the side of the valve operating chamber 15) to reach the other side (on the side of the oil reservoir chamber 13). The first shroud 25 has an inlet 26*i* and an outlet 26*o* communicating with the cooling-air passage 26 provided at its portion opposed to an outer end face of the rotor 21 and its portion opposed to the other side of the cylinder block 6, respectively.

An axial flow-type cooling fan, termed "the second cooling fan" 27 is secured to that outer end of the crankshaft 12 which protrudes from the outer side of the crankcase 7 adjacent the oil reservoir chamber 13, and an auxiliary shroud, designated "the second shroud", 28 cooperating with the auxiliary cooling fan 27 is mounted to the crankcase 7. The auxiliary shroud 28 is comprised of a truncated conical inlet portion 28*a*, a cylindrical guide portion 28*b* connected to a larger-diameter portion of the inlet portion 28*a*, an auxiliary guide portion 28*c* protruding from one side of the guide portion 28*b*, and an annular partition wall 28*d* protruding radially inwards from a boundary between the inlet portion 28*a* and the guide portion 28*b*. The auxiliary cooling fan 27 is disposed, so that it is surrounded at a small clearance by the partition wall 28*d*. The guide portion 28*b* is disposed to define an auxiliary cooling-air passage 30 between the guide portion 28*b* and an outer peripheral surface of the crankcase 7 at its end adjacent the oil reservoir chamber 13. The auxiliary guide portion 28*c* is disposed to define a second auxiliary cooling-air passage 31 between the auxiliary guide portion 28*c* and an end of the fuel tank 5 adjacent the oil reservoir chamber 13. A large number of slit-like inlet bores 32 are provided in a peripheral wall of the inlet portion 28*a*.

A known recoil starter 33, capable of cranking the crankshaft 12, is disposed within the auxiliary shroud 28. In this case, a rope-winding pulley 34 of the starter 33 is supported on an end wall of the inlet portion 28*a* of the auxiliary shroud 28, and a driven wheel 36 driven by the pulley 34 through a one-way clutch 35 is secured to the crankshaft 12 along with the auxiliary cooling fan 27.

The operation of this embodiment will be described below.

During operation of the engine E, the cooling fan 20 and the auxiliary cooling fan 27 are simultaneously driven by the crank shaft 12. Cooling air flow produced by rotation of the cooling fan 20 flows from the inlet 26*i* to the outlet 26*o* in the cooling air passage 26 within the shroud 25, while cooling portions of the engine in the region around the cylinder block 6.

On the other hand, cooling air flow produced by rotation of the auxiliary cooling fan 27 is drawn from the inlet bores 32 in the auxiliary shroud 28 and fed to the auxiliary cooling-air passage 30 and the second auxiliary cooling-air passage 31 to cool the crankcase 7 and the fuel tank 5. When the crankcase 7 is cooled in this manner, such cooling also absorbs heat from the cylinder block 6 having a high temperature, thereby assisting the cooling of the cylinder block 6.

Therefore, the effect of cooling of the cylinder block 6 can be enhanced without a dedicated increase in the amount of cooling air flowing in the cooling-air passage 26 within the shroud 25.

In addition, during the cooling, the lubricating oil O in the oil reservoir chamber 13 within the crankcase 7 adjacent the auxiliary cooling fan 27 is also cooled satisfactorily and hence, the lubrication and cooling of the inside of the engine can be effectively performed by the oil mist produced in the oil reservoir chamber 13.

Although the present has been described in detail, it will be understood that the present invention is not limited to the above-described embodiment, and various modifications may be made without departing from the spirit and scope of the invention defined in the claims. For example, cooling fins may be formed on an outer peripheral surface of the crankcase 7, so that enhanced cooling can be achieved. In addition, the auxiliary cooling fan 27 may be formed as a centrifugal type.

What is claimed:

1. An air cooled engine comprising:

a cylinder block, a crankcase divided into laterally spaced chambers including an oil reservoir chamber, a crank chamber and a valve operating chamber, a crankshaft rotably supported in said crankcase and connected to a piston disposed in said cylinder block, and opposite ends of said crankshaft extending through said oil reservoir chamber and said valve operating chamber, respectively, a first cooling fan fixed to said crankshaft at one end thereof for rotation therewith, means forming a first shroud enclosing said first cooling fan and having an air inlet and an air outlet disposed in mutually spaced regions of said first shroud whereby said first shroud is operative to guide cooling wind produced by said first cooling fan in cooling relation to an outer periphery of said cylinder block, a second cooling fan fixed to said crankshaft at the other end thereof for rotation therewith, and means forming a second shroud enclosing said second cooling fan and having an air inlet disposed adjacent said second fan and air outlet means disposed with respect to said second fan whereby said second shroud is operative to guide a flow of cooling air produced by said second cooling fan in cooling relation to an outer periphery of said crankcase.

2. An air cooled engine according to claim 1 in which said oil reservoir chamber is disposed adjacent one of said cooling fans.

3. An air cooled engine according to claim 2 in which said oil reservoir chamber is adjacent said second cooling fan.

4. An air cooled engine according to any one of claims 1 to 5 including a fuel tank disposed on one side of said crankcase and in which said second shroud means includes means operative to guide a portion of the cooling air produced by said second fan to an outer periphery of said fuel tank.

5. An air cooled engine according to claim 4 including a recoil starter mounted for operation by one of said shrouds, said recoil starter driving a driven wheel secured to said crankshaft adjacent the cooling fan enclosed by the shroud mounting said recoil starter.

6. An air cooled engine according to claim 5 in which said recoil starter is mounted for operation by said second shroud and said driven wheel is secured to said crankshaft adjacent said second cooling fan.

* * * * *